United States Patent [19]

Doench

[11] 3,951,091

[45] Apr. 20, 1976

[54] BILGE BLOWER IGNITION INTERCEPTOR

[75] Inventor: Thomas Judson Doench, Dayton, Ohio

[73] Assignee: Omnifac Corporation, Dayton, Ohio

[22] Filed: Apr. 16, 1975

[21] Appl. No.: 568,704

[52] U.S. Cl. ..... 114/211; 98/1; 115/.5 R; 123/179 B; 307/9

[51] Int. Cl.[2] ..... B63J 2/06

[58] Field of Search ..... 114/211; 115/.5 R; 98/1; 123/179 B, 179 BG; 307/9

[56] References Cited

UNITED STATES PATENTS

| | | | |
|---|---|---|---|
| 2,526,446 | 10/1950 | Zurit et al. | 115/.5 R |
| 2,569,252 | 9/1951 | Omeron | 123/179 B |
| 3,292,568 | 12/1966 | Morrell | 115/.5 R |
| 3,315,584 | 4/1967 | Van Ranst | 98/1 |
| 3,465,665 | 9/1969 | O'Day et al. | 98/1 |
| 3,489,912 | 1/1970 | Hoffman | 114/211 |
| 3,599,591 | 8/1971 | Edelson | 114/211 |
| 3,652,868 | 3/1972 | Hunt | 114/211 |
| 3,662,727 | 5/1972 | Abplanalp et al. | 307/9 |
| 3,675,034 | 7/1972 | Abplanalp et el. | 114/211 |
| 3,789,231 | 1/1974 | Hayden | 114/211 |

*Primary Examiner*—Trygve M. Blix
*Assistant Examiner*—Charles E. Frankfort
*Attorney, Agent, or Firm*—Biebel, French & Bugg

[57] ABSTRACT

A self-latching relay is connected in series with the ignition circuit of a power boat to interrupt power to the starter and ignition circuits until the relay is actuated. A thermal delay timer is connected to one of the control switches for the bilge blower system to time a predetermined interval after the bilge blower has been turned on. After the interval has been timed the ignition circuit is completed through the self-latching relay. An emergency override circuit is provided to bypass the timer, but includes warning means which continue in operation until the engine is stopped and restarted without the aid of the emergency override switch.

8 Claims, 2 Drawing Figures

BILGE BLOWER IGNITION INTERCEPTOR

BACKGROUND OF THE INVENTION

This invention relates to water craft, and more particularly to a safety device for requiring operation of the bilge blower of a power boat for a predetermined interval before the engine can be started.

Gasoline powered boats having inboard engines are almost universally equipped with bilge blowers for exhausting potentially explosive gasoline vapors from the engine compartment before the engine is started.

Numerous prior art safety interlocks require operation of the bilge blower before the engine may be started, or disable the engine if circumstances indicate an unsafe condition in the bilge atmosphere, or both. However, many of these include complicated mechanical interlocks which are expensive to manufacture, install, and maintain.

Other devices include electrical and/or electronic circuits to require that certain delay and/or environmental conditions be met before the engine may be started. Again, however, these circuits are generally quite complicated, unduly expensive, and in many cases poorly adapted for easy installation in boats which have already been manufactured.

SUMMARY OF THE INVENTION

Briefly, the present invention provides an inexpensive, uncomplicated circuit which may be readily incorporated into a power boat either at the time of manufacture or at any later time. A minimum of installation difficulty is involved. The original blower and ignition switches are retained, and only a small additional control plate needs to be installed on the control console of the boat.

The present circuit interrupts all power to the starter and ignition switches and their corresponding circuits until the blower has been operated for a predetermined time. An inexpensive thermal relay is energized when the blower is turned on, and when the thermal relay times out, a ready light indicates that the boat may be started. A first relay then provides power to the ignition switch, and when the ignition is energized, the first relay is electrically selflatched to enable continued operation of the boat should the operator turn off the blower switch.

If the boat must be started in less time than permitted by the timer, an emergency start circuit allows the timer to be bypassed. The emergency start circuit is connected in series with the blower switch, and includes a push button emergency start switch which energizes an electrically self-latching emergency override relay to energize the first relay. The emergency override relay is connected to be self-latching so that if it is energized while the ignition circuit is energized, it will remain energized until the ignition circuit is deenergized. A buzzer and warning light are connected in parallel with the emergency override relay to provide the operator with a continuous warning that the engine has been started with less than the normal operation of the bilge blower.

It is therefore an object of the present invention to provide an inexpensive, uncomplicated ignition interceptor for power boats having bilge blowers; an interceptor which requires operation of the bilge blower for a predetermined time before power is available to the ignition and starter circuits of the engine; which may be readily installed in virtually any boat; which can accommodate a wide variety of boat configurations; which includes an emergency override circuit for bypassing the timer in the event that the boat must be started immediately; which includes warning means which operate continuously whenever the timer has been bypassed and until the engine is again shut off; and to accomplish the above objects and purposes in an inexpensive, durable, and reliable configuration readily adapted to inexpensive mass production, and easy, uncomplicated installation.

Other objects and advantages of the invention will be apparent from the following description, the accompanying drawings and the appended claims.

DESCRIPTION OF THE PREFERRED EMBODIMENT

Figure 1:
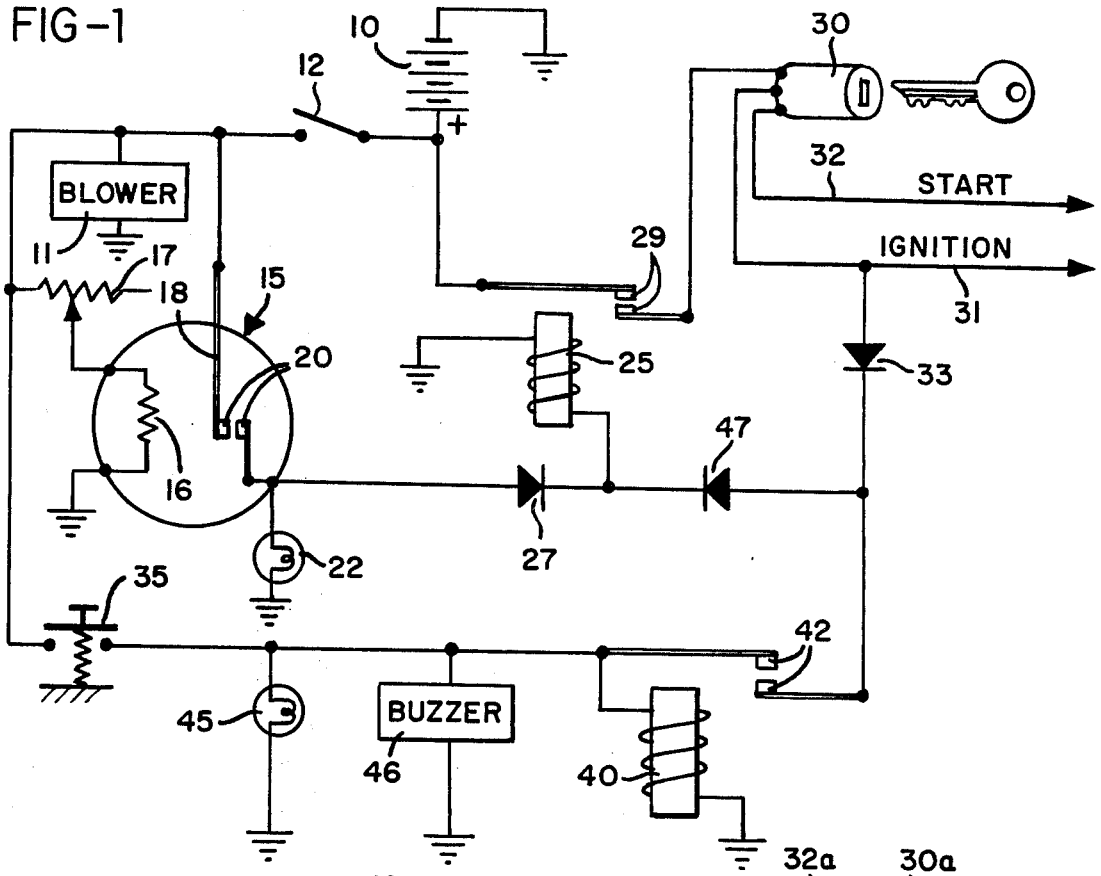
FIG. 1 is a schematic diagram of a first embodiment of the bilge blower ignition interceptor for a power boat having a single engine and a single bilge blower.

The ignition interceptor in FIG. 1 is designed for use with a conventional power boat having a conventional internal electrical system including starter and ignition circuits. Accordingly, only those portions of the boat system directly connected with the present invention are illustrated.

The boat battery 10 is connected to a conventional bilge blower 11 through a standard bilge blower control switch 12. Blower 11 may therefore be operated at any time by closing switch 12. A thermal time delay relay 15 is connected to the circuit of blower 11 so that when blower switch 12 is closed relay 15 is energized to start timing a predetermined time interval.

Thermal relay 15 includes a thermal element 16 which is energized by switch 12 through a variable resistance 17. Resistance 17 permits adjustment of the amount of current going into the heating element 16, which thereby varies the rate at which bi-metal arm 18 is heated within relay 15. Resistance 17 therefore allows the boat operator to vary the delay according to the requirements of his boat. Upon heating, arm 18 will be deflected to close timer contacts 20, one of which is carried on the movable end of arm 18.

Contacts 20, which may be viewed as the switch portion of thermal relay 15, are connected in parallel with blower 11. When time delay relay switch 20 is closed (with blower 11 continuing in operation) a ready light 22 is energized to indicate that the predetermined interval has been timed by the thermal time delay relay timer 15, and that it is now possible to start the boat engine.

ready light 22 is connected to a first relay 25 through a first diode 27. Activation of ready light 22 thus causes simultaneous actuation of first relay 25, through diode 27. This causes a pair of first relay contacts 29, serving as a switch 29, to close and complete a circuit from battery 10 to the conventional ignition switch 30 of the boat engine. At this point the battery is connected to the ignition switch 30 for the ignition and starter circuits 31 and 32 of the engine, so that the boat may be started.

When ignition switch 30 is turned to the on position to energize the ignition circuit 31, a second diode 33 and third diode 47, which are connected between the ignition circuit 31 and first relay 25, supply power to relay 25 to maintain it in its actuated condition. At this point relay 25 is electrically self-latching, since the power which maintains it in its actuated, or energized, condition flows through its own contacts 29, then through switch 30 and diodes 33 and 47.

Since relay 25 is electrically self-latching when the boat ignition circuit 31 is energized, the blower 11 may now be turned off, by opening blower switch 12, without interrupting the supply of power to the ignition circuit 31. First diode 27 prevents power from passing back through timer switch 20 to blower 11 and thermal element 16.

In the event that the boat engine must be started quickly, the present invention provides an emergency override circuit for bypassing timer 15. The emergency override circuit includes an emergency override push button switch 35 connected in series with blower switch 12. Switch 35 therefore requires that the blower 11 be switched on since it receives its power through blower switch 12. So, when the blower is operating and the emergency switch 35 is closed, it immediately actuates a second relay 40. Relay 40 then closes a pair of second relay contacts 42, which serve as a second relay switch 42 and are connected to supply power from switch 35 to first relay 25 through third diode 47. Thus relay 25 is actuated to close the first relay contacts 29 without first having to wait for timer 15 to time out.

Since the emergency override circuit is not ordinarily to be used, it also includes an emergency start warning light 45 and buzzer 46. These are wired in parallel with second relay 40 so that whenever relay 40 is energized light 45 and buzzer 46 will also be energized to provide a warning.

For an emergency start, switches 12 and 35 must remain closed until the ignition circuit 31 is energized through operation of ignition switch 30. Once energized, power then flows through second diode 33 and third diode 47 to relay 25, and also through the second relay contacts 42 to continue energizing second relay 40 and the warning light and buzzer 45 and 46. Thus second relay 40 becomes electrically self-latching and holds its contacts 42 closed when the first relay switch 29 and the ignition switch 30 are closed at the same time, and will remain this way as long as the ignition remains on. In this way, the warning light and buzzer 45 and 46 continue operation even after the blower switch 12 and/or emergency override switch 35 are opened. The boat operator is thus automatically and continuously reminded that the bilge blower has not been operated for the requisite interval. Of course, the blower switch 12 may—and in fact should—remain closed following an emergency start, and if it does, the timer, although bypassed, will operate and continue to time its predetermined time interval. When the interval has timed out, the ready light 22 will come on to signal the driver that the may now start the engine through a normal start procedure without further delay.

In order to reset the emergency bypass circuit and discontinue operation of the warning light and buzzer 45 and 46, the ignition switch must be turned off.

Figure 2:
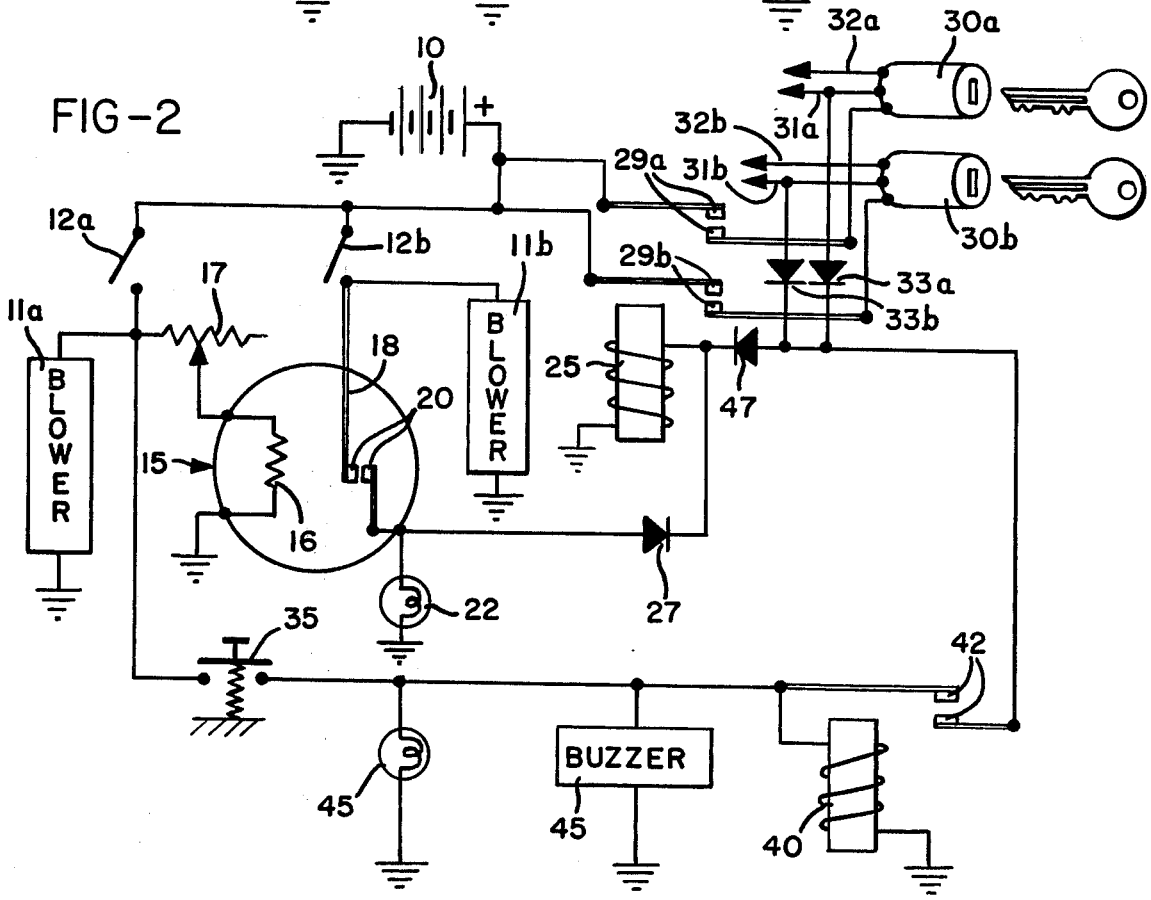
FIG. 2 is a schematic diagram of another embodiment adapted for a power boat having two engines and two separately controlled bilge blowers.

The circuit in FIG. 2 is basically the same as that of FIG. 1, but includes two slight modifications, the first providing for two separate engines, the second for two separate blowers and blower switches. In this case, the two ignition circuits 31*a* and 31*b* are connected in parallel to first delay 25 through respective second diodes 33*a* and 33*b*. The first blower 11*a* is operated by its respective blower switch 12*a*, and the thermal element 16 of timer 15 is energized thereby. Timer switch 20, however, is energized through the blower switch 12*b* which controls operation of the second blower 11*b*. With this arrangement, both blowers must be operated before the boat engine may be started. Dual engine boats with a single blower can combine the time-delay circuit of FIG. 1 with the double ignition switch circuit of FIG. 2.

As may be seen, therefore, the present invention provides numerous advantages. The circuitry is uncomplicated and may therefore be produced in an inexpensive and compact size. It may be attached to a boat with minimum intervention in the existing boat circuitry. Unlike some prior art devices, no power whatsoever is available to the starter or ignition circuits with the present invention until the blower has operated for the predetermined time interval. Thus the likelihood of an accidental electrical spark in the engine compartment is reduced to a minimum.

The present invention makes it possible to start the engine quickly by means of the emergency override circuit, but through the use of an electrically self-latching relay, the operator is continuously reminded that he has not followed ordinary operating procedures.

Since the first relay 25 is electrically self-latching, it permits the engine and blower to be operated independently of each other once the engine has been started. Similarly, the timer itself works independently of the emergency start circuit, so that the ready light 22 operates only when the timer has in fact timed out the full delay period. The ready light thus gives a true indication of the proper timed interval, independently of the emergency start circuit.

The present invention is also readily applicable to boats having multiple power systems and multiple blowers, and again requires a minimum of intervention for installation therein.

Other variations are also contemplated within the scope of the present invention. For example, solid state switches or their equivalent may be used in lieu of the electro-mechanical relays which have been illustrated. Thus, while the forms of apparatus herein described constitute preferred embodiments of this invention, it is to be understood that the invention is not limited to these precise forms of apparatus, and that changes may be made therein without departing from the scope of the invention.

What is claimed is:

1. For use in a boat having at least one engine, an engine compartment, an ignition circuit including a manually actuated ignition switch for the engine, a blower system for ventilating the engine compartment, and at least one blower switch for controlling the blower system, an ignition interceptor for the ignition circuit comprising:

a. a timer actuated by a blower switch for timing a predetermined interval, said timer including a timer switch which is closed by said timer after said timer has timed said interval, b. first switch means, said first switch means including a first switch connected in series with the ignition switch for interrupting power to the ignition circuit, c. means connecting said first switch means to said timer switch for closing said first switch when said timer switch is closed, and d. means connecting the manually actuated ignition switch to said first switch means for controlling said first switch means to hold said first switch closed when the ignition switch is also closed.

2. The ignition interceptor of claim 1 wherein said timer is a thermal timer, and further comprising variable resistance means for adjustably presetting said predetermined time interval of said timer.

3. The ignition interceptor of claim 1 wherein said means connecting said first switch means to said timer switch includes a blower switch in series with said timer switch, and further comprising a diode in series therewith for permitting said timer switch and the blower switch in series therewith to control said first switch means to close said first switch while preventing a reverse flow of current from said first switch means back through said timer switch.

4. The ignition interceptor of claim 1 wherein said means connecting the ignition switch to said first switch means further comprises a diode in series therewith for permitting said first switch and ignition switch to control said first switch means to hold said first switch closed while preventing a reverse flow of current from said first switch means back through said ignition switch.

5. The ignition interceptor of claim 1 further comprising:

a. an emergency override switch in series with a blower switch, b. a second switch means including a second switch, said second switch means being connected to said emergency override switch to close said second switch when said emergency override switch and the blower switch in series therewith are both closed, c. means connecting said second switch to said first switch means to close said first switch when said second switch is closed, d. means connecting said first switch and the ignition switch to said second switch and said second switch means for holding said second switch closed when said first, second, and ignition switches are closed, and e. warning means connected to said second switch means for providing a warning whenever said second switch is closed.

6. For use in a boat having at least one engine, an engine compartment, an ignition circuit including an ignition switch for the engine, a blower system for ventilating the engine compartment, and at least one blower switch for controlling the blower system, an ignition interceptor for the ignition circuit comprising:

a. a timer for timing a predetermined interval, said timer being actuated when at least a portion of the blower system is turned on, b. a first switch means including a first switch connected in series with the ignition switch for interrupting the ignition circuit until said portion of the blower system has operated for said predetermined interval, said first switch means being actuatable by the timer when the timer has timed said predetermined interval to close said first switch, and said first switch means being connected to be self-latching into its actuated condition when the ignition circuit is energized, c. an emergency override switch connected in series with a blower switch, d. a second switch means actuatable by the emergency override switch to actuate said first switch means independently of said timer, said second switch means being connected to be self-latching when the ignition circuit is energized while said second switch means is in its actuated condition, and e. warning means connected to said second switch means and being energized when said second switch means is in its actuated condition to continue providing a warning as long as said second switch means remains in its actuated condition.

7. For use in a boat having at least one engine, an engine compartment, an ignition circuit including an ignition switch for the engine, a blower system for ventilating the engine compartment, and at least one blower switch for controlling the blower system, an ignition interceptor for the ignition circuit comprising:

a. a time delay circuit connected for timing a predetermined interval when at least a portion of the blower system is energized by a blower switch, and for providing a timer output upon completion of the timed interval, b. a first switch means including a first switch connected in series with the ignition circuit, said first switch being open to interrupt the ignition circuit when said first switch means is not energized, said time delay circuit being connected to said first switch means to energize said first switch means and close said first switch in response to said timer output, c. means connected to the ignition switch and said first switch for energizing said first switch means when said first switch and the ignition switch are both closed, d. an emergency override switch connected in series with a blower switch, e. an emergency override switch means connected to said emergency override switch and energized thereby and by the blower switch in series therewith to energize said first switch means when both said emergency override and blower switches are closed, independently of said time delay circuit, f. warning means energized in parallel with said emergency override switch means, and g. means connected to said emergency override switch means to continue energizing said emergency override switch means when the ignition circuit is energized while said emergency override switch means is energized, to continue energizing said first switch means and said warning means until the ignition circuit is deenergized.

8. For use in a boat having at least one engine, an engine compartment, an ignition circuit including an ignition switch for the engine, a blower system for ventilating the engine compartment, and at least one blower switch for controlling the blower system, an ignition interceptor for the ignition circuit comprising:

a. a thermal timer actuated by a blower switch for timing a predetermined interval, said timer including a timer switch which is closed by said timer after said timer has timed said interval, b. variable resistance means for adjustably presetting said predetermined time interval of said timer, c. a first switch means, said first switch means including a first switch connected in series with the ignition switch for interrupting power to the ignition circuit, d. blower switch in series with said timer switch and a diode connecting said timer switch to said first switch means to control said first switch means for closing said first switch when said timer switch and the blower switch in series therewith are closed while preventing a reverse flow of current from said first switch means back through said timer switch, e. a diode connecting the ignition switch to said first switch means for permitting said first switch and ignition switch to control said first switch means to hold said first switch closed when the ignition switch is also closed while preventing a reverse flow of current from said first switch means back through said ignition switch, f. an emergency override switch in series with a blower switch, g. a second switch means including a second switch, said second switch means being connected to said emergency override switch to close said second switch when said emergency override switch and the blower switch in series therewith are both closed, h. a diode connecting said second switch to said first switch means to close said first switch when said second switch is closed while preventing a reverse flow of current from said first switch means back through said second switch, i. means connecting said first switch and the ignition switch to said second switch and said second switch means for holding said second switch closed when said first, second, and ignition switches are closed, and j. warning means connected to said second switch for providing a warning whenever said second switch is closed.

* * * * *